US007614897B2

(12) United States Patent
Lopez

(10) Patent No.: US 7,614,897 B2
(45) Date of Patent: Nov. 10, 2009

(54) ELECTRICAL CONNECTOR SYSTEM AND METHOD OF ASSEMBLY

(75) Inventor: Ramon Pinana Lopez, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 12/031,907

(22) Filed: Feb. 15, 2008

(65) Prior Publication Data

US 2009/0209116 A1 Aug. 20, 2009

(51) Int. Cl.
*H01R 13/64* (2006.01)

(52) U.S. Cl. ..... 439/248

(58) Field of Classification Search ..... 439/248, 439/247, 364, 903, 598, 131, 135, 148, 359, 439/361, 362

See application file for complete search history.

(56) References Cited

U.S. PATENT DOCUMENTS 3,094,364 A * 6/1963 Liagg ..... 439/247
3,173,734 A * 3/1965 Hartwell ..... 439/291
3,562,696 A * 2/1971 Barnhart et al. ..... 439/278
4,647,130 A * 3/1987 Blair et al. ..... 439/248
4,780,090 A * 10/1988 Sugiyama et al. ..... 439/247
4,957,449 A * 9/1990 Hatagishi ..... 439/364
D320,382 S * 10/1991 Nagasaka et al. ..... D13/147
5,217,386 A * 6/1993 Ohsumi et al. ..... 439/364
5,336,116 A 8/1994 Boteler
5,431,573 A * 7/1995 Endo et al. ..... 439/157
5,480,322 A * 1/1996 Ishii et al. ..... 439/378
5,486,119 A * 1/1996 Nabeshima et al. ..... 439/489
5,490,799 A * 2/1996 Yamamoto ..... 439/489
5,545,053 A * 8/1996 Ishii et al. ..... 439/364
5,601,450 A * 2/1997 Nabeshima et al. ..... 439/489
5,795,173 A 8/1998 Werner et al.
5,813,880 A * 9/1998 Kodama ..... 439/364
5,820,405 A * 10/1998 Yagi et al. ..... 439/489
5,836,787 A * 11/1998 Kodama ..... 439/567
6,027,360 A * 2/2000 Jenkins ..... 439/364
6,511,340 B1 * 1/2003 Lopez ..... 439/364
7,104,810 B2 9/2006 Kawakita et al.

* cited by examiner

*Primary Examiner*—T C Patel
*Assistant Examiner*—Harshad C Patel
(74) *Attorney, Agent, or Firm*—Brooks Kushman P.C.

(57) ABSTRACT

An electrical connector system and a method of assembly. The electrical connector system includes a frame, a connector, and a junction box. The connector is configured to be inserted into the frame. First and second sets of electrical contacts are engaged when the connector and junction box engage the frame and the connector is actuated toward the junction box.

20 Claims, 4 Drawing Sheets

ELECTRICAL CONNECTOR SYSTEM AND METHOD OF ASSEMBLY

BACKGROUND OF THE INVENTION

Field of the Invention

The present invention relates to an electrical connector system.

SUMMARY OF THE INVENTION

In at least one embodiment of the present invention, an electrical connector system is provided. The electrical connector system includes a frame, a connector, and a junction box. The frame has a cavity, a first cavity opening, and a second cavity opening that includes a slot. The connector has a first set of electrical contacts, a flange, and a first mounting feature. The junction box has a second set of electrical contacts and a second mounting feature. The first and second sets of electrical contacts are engaged when the connector is inserted into the cavity through the second cavity opening, the junction box engages the frame, and first and second mounting features are engaged to actuate the connector toward the junction box.

In at least one embodiment of the present invention an electrical connector system is provided. The electrical connector system includes a frame having a cavity, a connector, and a junction box. The connector has a first set of electrical contacts, a flange, and a first mounting feature. The junction box has a second set of electrical contacts and a second mounting feature. The first and second sets of electrical contacts are engaged when the connector and junction box are at least partially inserted into the cavity and the first and second mounting features cooperate to actuate the connector toward the junction box.

In at least one other embodiment of the present invention, a method of assembling an electrical connector system is provided. A frame is provided that has a cavity, a first cavity opening disposed on a first side of the frame, and a second cavity opening disposed on a second side of the frame. The second cavity opening has a slot. A connector is provided that has a body, a flange, a first set of electrical contacts, and a threaded hole. A junction box is provided that has a fastener and a second set of electrical contacts. The method includes aligning the flange with the slot, inserting the connector through the second cavity opening into the cavity, positioning the junction box on the frame, engaging the fastener and the threaded hole, and rotating the fastener to move the connector toward the junction box to engage the first set of electrical contacts with the second set of electrical contacts.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
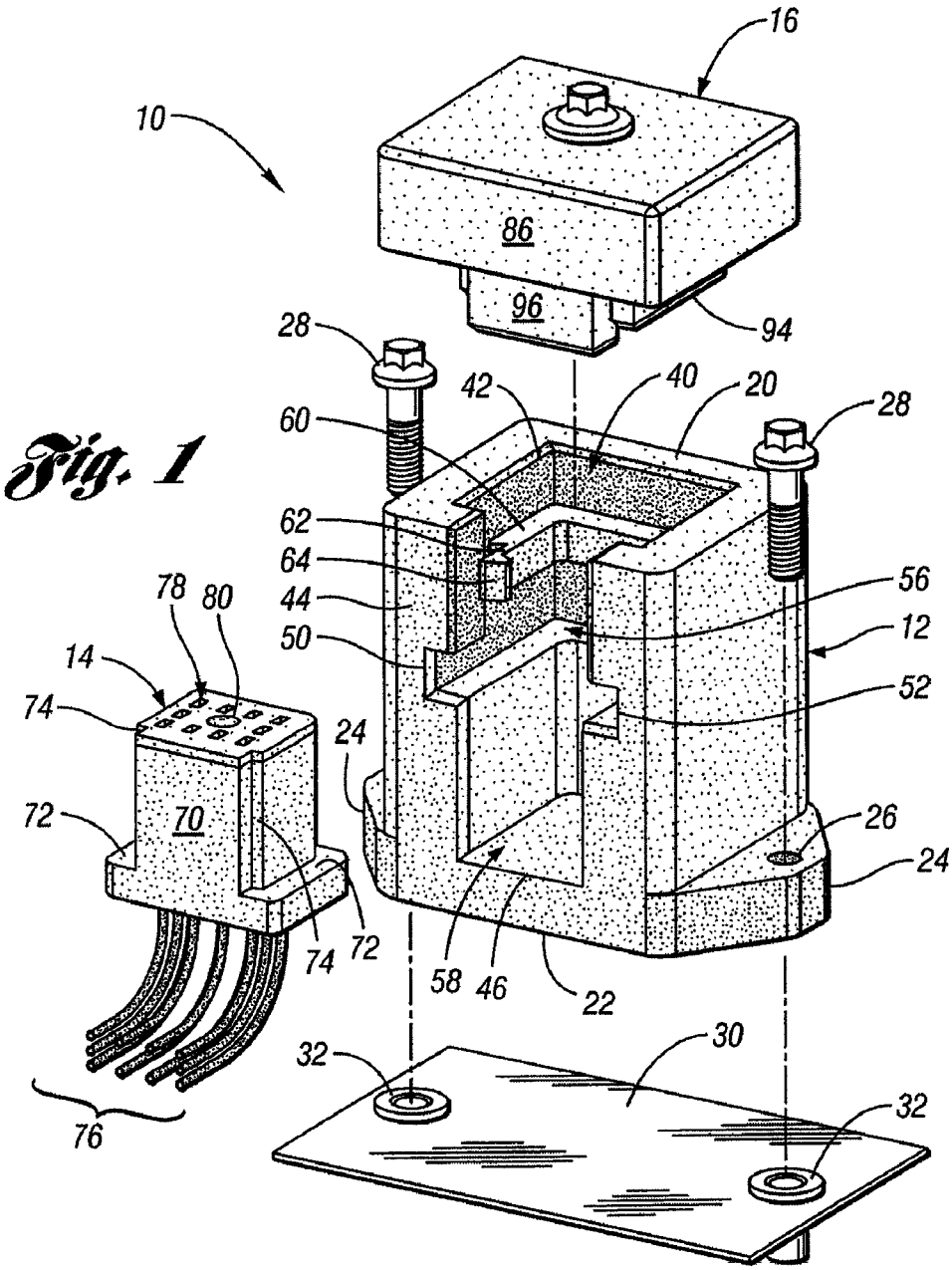
FIG. 1 is a perspective view of a electrical connector system.

Referring to FIG. 1, an electrical connector system 10 is shown. The electrical connector system 10 may be provided to make electrical connections for one or more electrical circuits. In at least one embodiment, the electrical connector system 10 may be provided with a vehicle, such as a motor vehicle like a car or truck. The present invention also contemplates that the electrical connector system may be provided with non-vehicular applications, such as appliances, consumer electronics, building electrical systems, and heating and cooling systems.

In at least one embodiment, the electrical connector system 10 may include a frame 12, a connector 14, and a cap or junction box 16.

The frame 12 may have any suitable configuration and may be made of any suitable material, such as a polymeric material like plastic. In at least one embodiment, the frame 12 may include a top surface 20 and a bottom surface 22. The bottom surface 22 may partially define one or more flanges 24. The flange 24 may have an opening 26, such as a hole or slot, for receiving a fastener 28. The fastener 28 may be used to attach the frame 12 to a mounting surface 30. Optionally, the mounting surface 30 may include one or more holes 32 for receiving a corresponding fastener 28. In a vehicular application the mounting surface 30 may be a vehicle component, such as a chassis or body structure.

The frame 12 may also include a cavity 40 that is configured to at least partially receive the connector 14. The cavity 40 may extend at least partially from the top surface 20 toward the bottom surface 22. The top surface 20 may at least partially define a first cavity opening 42. A side 44 of the frame 12 may at least partially define a second cavity opening 46. In the embodiment shown in FIG. 1, the first and second cavity openings 42,46 intersect.

The first cavity opening 42 may have any suitable configuration that is compatible with the junction box 16. In the embodiment shown in FIG. 1, the first cavity opening 42 is generally rectangular.

The second cavity opening 46 may have any suitable configuration that is compatible with the connector 14. For instance, the second cavity opening 46 may include at least one slot that is configured to receive a portion of the connector 14 as will be discussed in more detail below. In the embodiment shown in FIG. 1, the second cavity opening 46 has first and second slots 50,52. The first and second slots 50,52 may be aligned with each other as shown in FIG. 1 or may be provided in a non-aligned arrangement in one or more embodiments of the present invention.

The cavity 40 may include a first portion 56 and a second portion 58. The first portion 56 may generally be disposed at the top of the cavity 40. The second portion 58 may generally be disposed at the bottom of the cavity 40 and adjacent to the first portion 56. In FIG. 1, the second portion 58 is disposed below the first and second slots 50,52. The second portion 58 and may provide clearance for one or more wires that may extend from the connector 14. The first and second portions 56,58 may have different configurations. For instance, the first portion 56 may generally be larger than the second portion 58 to permit movement of the connector 14 as will be discussed in more detail below.

A retaining feature 60 may be disposed in the cavity 40. The retaining feature 60 may have any suitable configuration. In the embodiment shown, the retaining feature 60 is configured as a generally U-shaped clip and is disposed in the first portion 56 of the cavity. The retaining feature 60 may include one or more flexible arms 62 that flex to permit insertion or removal of the connector 14 through the second cavity opening 46. The flexible arms 62 may each include a protrusion 64 that helps retain the connector 14. For instance, each protrusion 64 may engage a groove in the connector 14 to permit the connector 14 to slide toward or away from the top surface 20 as will be discussed in more detail below. In the embodiment shown, a protrusion 64 is generally disposed at the end of each flexible arm 62 and within the first portion 56 of the cavity. The retaining feature 60 may be integrally formed with the frame 12 or may be provided as a separate component.

The connector 14 may include a body 70. The body 70 may be made of any suitable material, such as a polymeric material like plastic that may also act as an electrical insulator. The body 70 may include one or more flanges 72 and one or more grooves 74. The flanges 72 may extend outwardly from one or more sides of the body 70. In the embodiment shown in FIG. 1, flanges 72 extend from opposing sides of the body 70 and are configured to be inserted through the first and second slots 50,52. The grooves 74 may generally extend along the body 70 and may be configured to receive a protrusion 64 of the retaining feature 60. In the embodiment shown in FIG. 1, the grooves 74 generally extend perpendicularly from the flanges 74. The flanges 72 and grooves 74 may help insure that the connector 14 is properly oriented when inserted into the frame 12.

The body 70 may also include a plurality of wires 76, a plurality of contacts 78, and a mounting feature 80. The wires 76 may extend from the body 70 and be part of an electrical circuit. Each wire 76 may engage one or more contacts 78. The contacts 78 may have any suitable configuration. In the embodiment shown in FIG. 1, the contacts 78 are generally disposed in the body 70 and spaced apart from each other. Alternatively, one or more contacts 78 may extend from the body 70 in one or more embodiments of the present invention.

The mounting feature 80 may be configured to engage the junction box 16. In the embodiment shown, the mounting feature 80 is configured as a threaded hole and is generally disposed at the center of the body 70 to help position the connector 14 relative to the junction box 16 and to reduce installation effort. Alternatively, the mounting feature 80 may be provided with a male configuration in one or more embodiments of the present invention.

Figure 2:
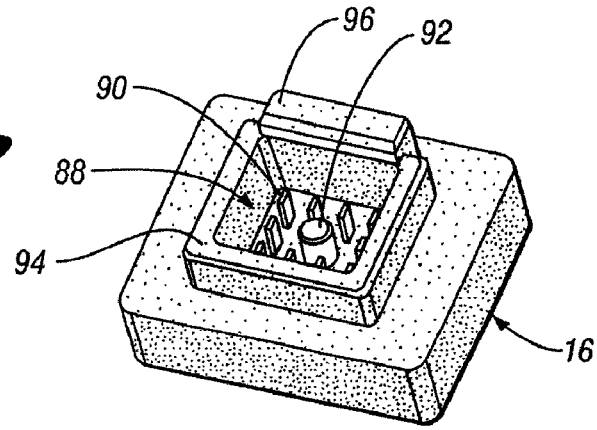
FIG. 2 is a perspective view of a junction box of the electrical connector system.

The junction box 16 may be configured to engage the frame 12 and the connector 14. As is best shown in FIGS. 1 and 2, the junction box 16 may include a body 86 having a cavity 88. The cavity 88 may receive a plurality of contacts 90. A mounting feature 92, such as a fastener, may extend toward the cavity 88 and may be configured to mate with the mounting feature 80 on the connector 14. A rim 94 may extend from the body 86 and may be disposed at least partially around the cavity 88. The rim 94 may be configured to be inserted into the first portion 56 of the cavity 40 between the frame 12 and the connector 14. The body 86 may also include an orientation feature 96 that helps ensure that the junction box 16 is in a desired orientation prior to engagement with the connector 14. The orientation feature 96 may extend from the rim 94 in one or more directions as shown in FIG. 2. Alternatively, the orientation feature 96 may be spaced apart from the rim 94 in one or more embodiments of the present invention.

Figure 3A:
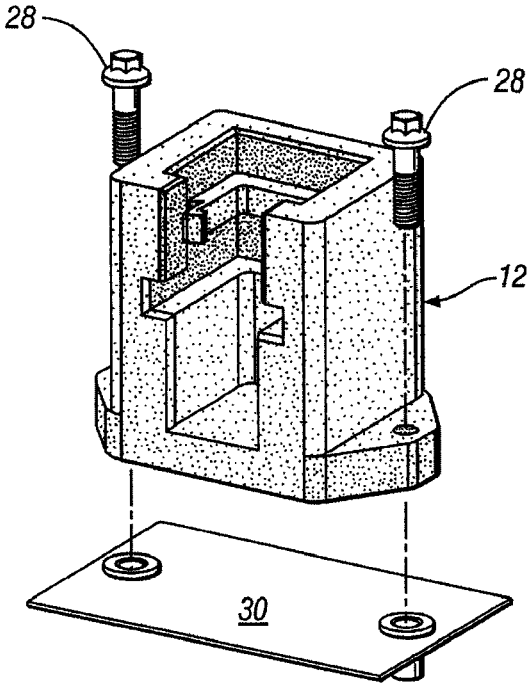
FIGS. 3*a*-3*f* are perspective views illustrating assembly of the electrical connector system.
Figure 3B:
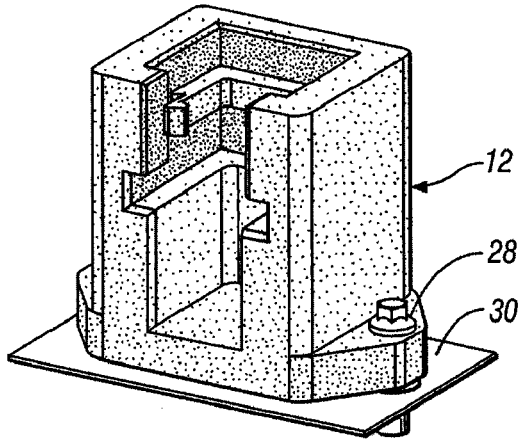
Figure 3C:
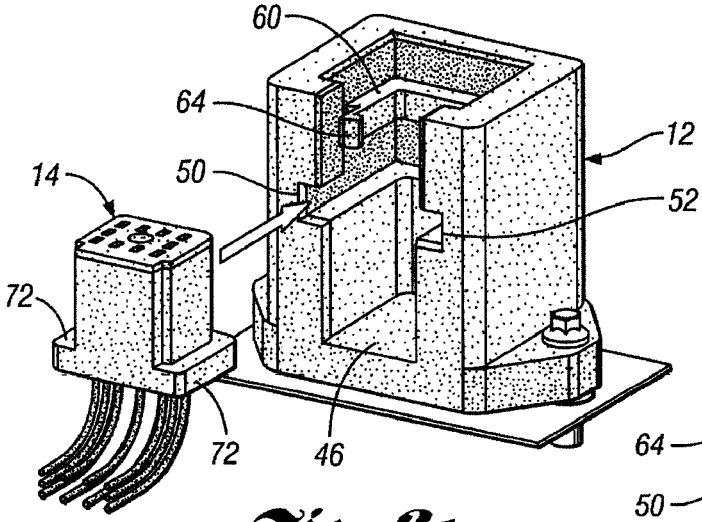
Figure 3D:
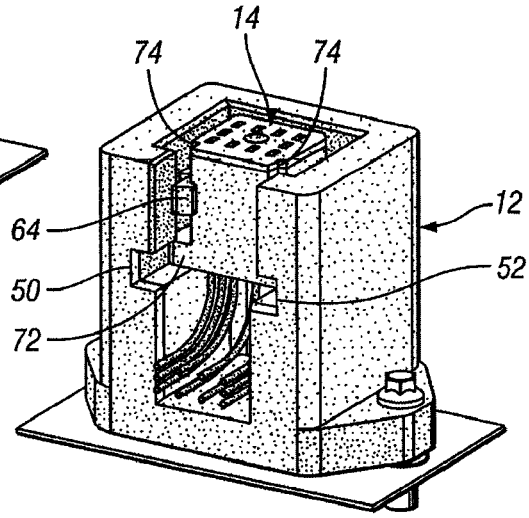
Figure 3E:
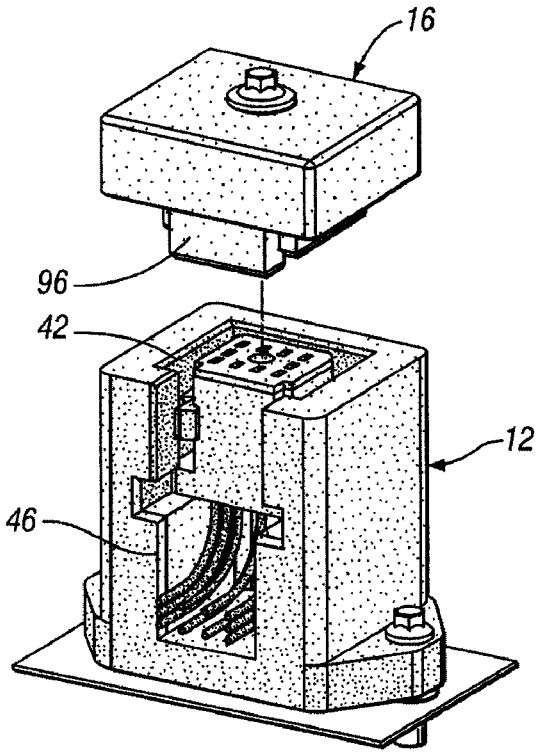
Figure 3F:
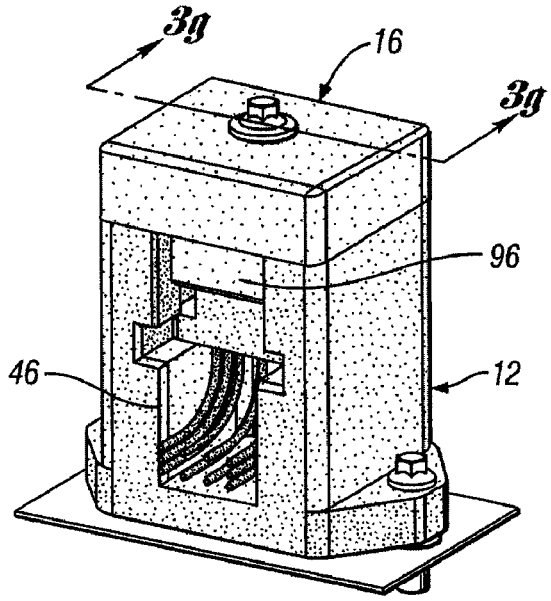
Figure 3G:
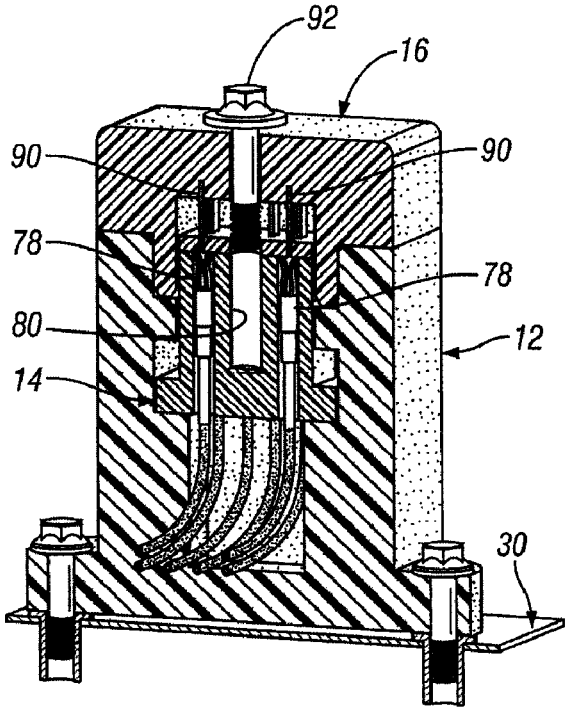
FIGS. 3*g* and 3*h* are section views illustrating assembly of the electrical connector system.
Figure 3H:
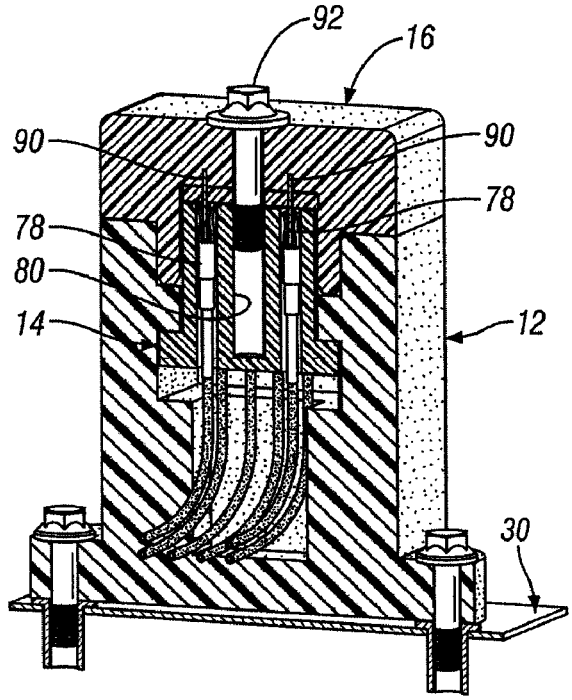
Figure 4:
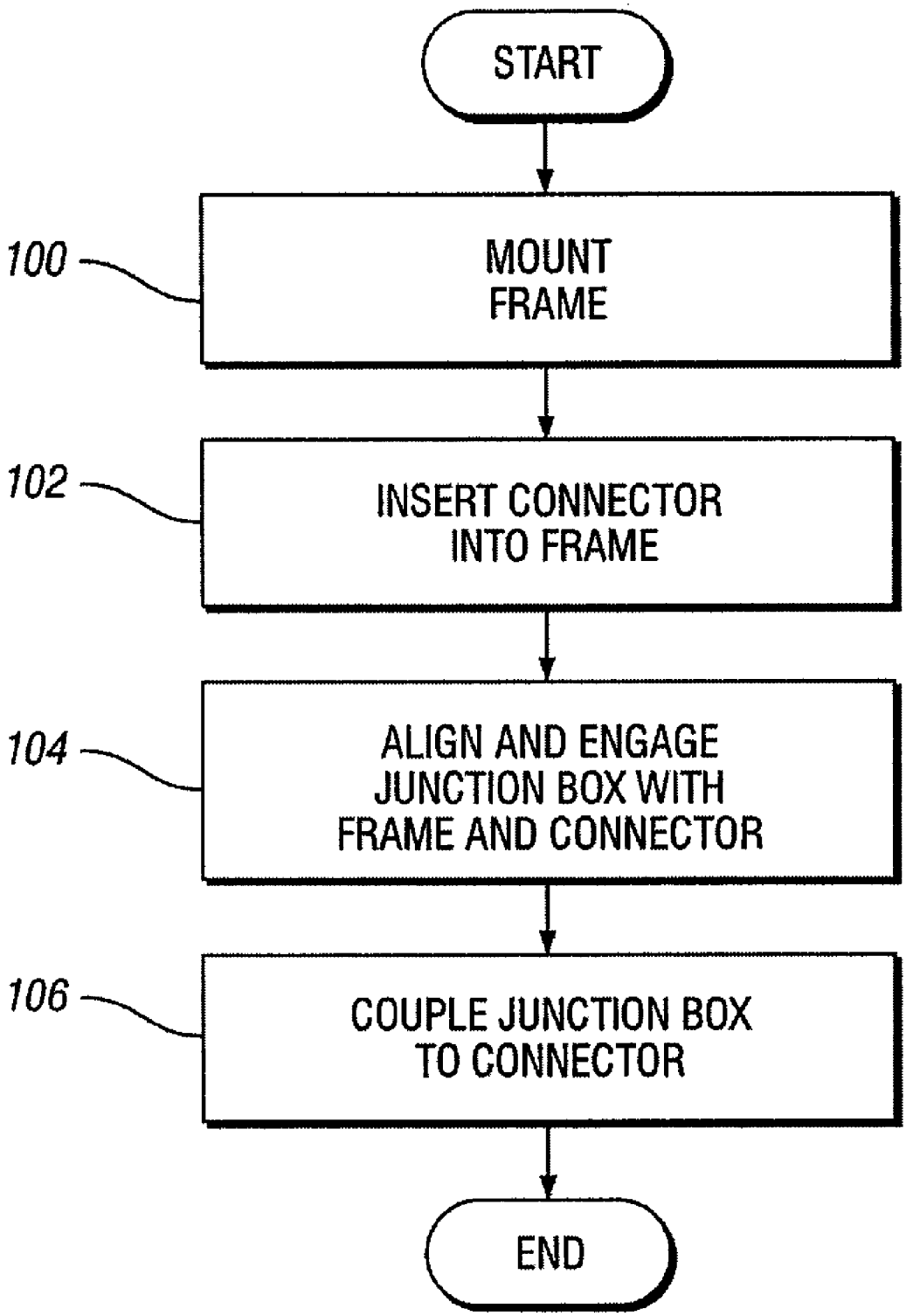
FIG. 4 is a flowchart of a method of assembling the electrical connector system.

Referring to FIG. 4, an exemplary method for assembling the electrical connector assembly is shown. The exemplary method will be described with reference to FIGS. 3*a*-3*h* as discussed below.

At 100, the frame 12 may be mounted to the mounting surface 30 in a stationary position. For example, the frame 12 may be positioned on the mounting surface 30 in a desired location (FIG. 3*a*) and one or more fasteners 28 may be provided to attach the frame 12 to the mounting surface (FIG. 3*b*).

At 102, the connector 14 may be inserted into the frame 12. The connector 14 may be oriented such that the flanges 72 on the connector 14 are aligned with the slots 50,52 on the frame 12 (FIG. 3*c*). Then the connector 14 may be inserted through the second cavity opening 46 and into the retaining feature 60 such that the protrusions 64 on the retaining feature 60 engage corresponding grooves 74 on the connector 14 (FIG. 3*d*).

At 104, the junction box 16 may be aligned with and positioned into engagement with the frame 12 and the connector 14. The junction box 16 may be aligned by positioning the orientation feature 96 over the first and second cavity openings 42,46 (FIG. 3*e*). Then the junction box 16 may be positioned on the frame 12 and into alignment with the connector 14 (FIG. 3*f*).

At 106, the junction box 16 may be coupled to the connector 14. For example, the mounting feature 92 on the junction box 16 may be engaged with the mounting feature 80 on the connector 14 (FIG. 3*g*). Then the mounting feature 92 may be rotated and threaded into the connector 14 to actuate the connector 14 toward the junction box 16, thereby engaging the contacts 78 on the connector 14 with corresponding contacts 90 on the junction box 16 (FIG. 3*h*). The connector 14 may engage the underside of the retaining feature 60 and/or a portion of the frame 12 to help secure the junction box 16 to the connector 14 and the connector 14 to the frame 12.

The present invention may help insure proper assembly of electrical connector system components to create secure and properly aligned electrical contacts. Moreover, the present invention may help reduce component tolerances while helping center actuation forces associated with movement of the connector relative to the junction box to help reduce overall assembly efforts and reduce misalignment of electrical contacts.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical connector system comprising:

a frame having a cavity, a first cavity opening, and a second cavity opening having a slot;

a connector having a first set of electrical contacts, a flange, and a first mounting feature; and a junction box having a second set of electrical contacts, a second mounting feature and an orientation feature that extends into the first and second cavity openings;

wherein the first and second sets of electrical contacts are engaged when the connector is inserted into the cavity through the second cavity opening, the junction box engages the frame, and first and second mounting features are engaged to actuate the connector toward the junction box.

2. The electrical connector system of claim 1 further comprising a retaining feature disposed in the cavity.

3. The electrical connector system of claim 2 wherein the cavity has first and second portions disposed adjacent to each other, wherein the first portion receives the retaining feature and a body of the connector and the second portion receives wires that extend from the connector.

4. The electrical connector system of claim 1 wherein the first mounting feature is a threaded fastener and the second mounting feature is a threaded hole disposed at the center of the connector.

5. The electrical connector system of claim 1 wherein the frame is configured to be mounted on a mounting surface.

6. The electrical connector system of claim 1 wherein the junction box further comprises a junction box cavity that receives the second set of electrical contacts and a rim that extends around the junction box cavity.

7. The electrical connector system of claim 6 wherein the junction box further comprises an orientation feature that extends from the rim into the second cavity opening.

8. An electrical connector system comprising:

a frame having a cavity, a first cavity opening, and a wall disposed opposite the first cavity opening;

a connector having a first set of electrical contacts and a first mounting feature;

a retaining feature disposed in the cavity and having a flexible arm and a protrusion extending from the flexible arm, and wherein the connector has a groove that receives the protrusion; and a junction box having a second set of electrical contacts and a second mounting feature;

wherein the first and second sets of electrical contacts are engaged when the connector and junction box are at least partially inserted into the cavity and the first and second mounting features cooperate to actuate the connector toward the junction box.

9. The electrical connector system of claim 8 wherein the frame has a top side that at least partially defines the first cavity opening and a second side that extends from the top side that at least partially defines a second cavity opening.

10. The electrical connector system of claim 9 wherein the first and second cavity openings intersect, the first cavity opening receives the junction box, and the second cavity opening receives the connector.

11. The electrical connector system of claim 8 wherein the junction box further comprises an orientation feature.

12. The electrical connector system of claim 11 wherein the groove extends from a flange disposed on the connector and the protrusion slides in the groove when the connector is actuated toward the junction box.

13. The electrical connector system of claim 8 further comprising a retaining feature disposed between the junction box and a slot in a second cavity opening.

14. The electrical connector system of claim 13 wherein the retaining feature inhibits rotation of the connector when at least one of the first and second mounting features is rotated.

15. A method of assembling an electrical connector system comprising:

providing a frame having a cavity, a first cavity opening disposed on a first side of the frame, and a second cavity opening disposed on a second side of the frame, the second cavity opening having a slot;

providing a connector having a body, a flange, a first set of electrical contacts, and a threaded hole;

providing a junction box having a fastener, a second set of electrical contacts and an orientation feature;

aligning the flange with the slot;

inserting the connector through the second cavity opening into the cavity;

positioning the junction box on the frame such that the orientation feature is disposed in the first and second cavity openings;

engaging the fastener and the threaded hole; and rotating the fastener to move the connector toward the junction box to engage the first set of electrical contacts with the second set of electrical contacts.

16. The method of claim 15 further comprising the step of mounting the frame in a stationary position on a mounting surface.

17. The method of claim 15 wherein the frame further comprises a retaining feature and the step of inserting the connector through the second cavity opening into the cavity further comprises inserting the connector into the retaining feature.

18. The method of claim 15 wherein the junction box further comprises a rim that extends around the second set of electrical contacts and the step of positioning the junction box on the frame further comprises positioning the rim into the first cavity opening between the frame and the connector.

19. The method of claim 15 wherein the the connector moves substantially linearly toward the junction box.

20. The method of claim 15 wherein the flange is spaced apart from the slot to inhibit removal of the connector from the cavity when the first and second sets of electrical contacts are engaged.

* * * * *